US011376615B2

(12) United States Patent
Dartevelle et al.

(10) Patent No.: US 11,376,615 B2
(45) Date of Patent: Jul. 5, 2022

(54) ASSEMBLY FOR DISPENSING A FLUID PRODUCT

(71) Applicant: APTAR FRANCE SAS, Le Neubourg (FR)

(72) Inventors: Arnaud Dartevelle, Periers sur le Dan (FR); Regis Jacquemart, Cerquigny (FR)

(73) Assignee: APTAR FRANCE SAS, Le Neuborug (FR)

( * ) Notice: Subject to any disclaimer, the term of this patent is extended or adjusted under 35 U.S.C. 154(b) by 230 days.

(21) Appl. No.: 16/633,677

(22) PCT Filed: Jul. 19, 2018

(86) PCT No.: PCT/FR2018/051845
§ 371 (c)(1),
(2) Date: Jan. 24, 2020

(87) PCT Pub. No.: WO2019/020909
PCT Pub. Date: Jan. 31, 2019

(65) Prior Publication Data

US 2021/0354153 A1 Nov. 18, 2021

(30) Foreign Application Priority Data

Jul. 25, 2017 (FR) ..... 1757067

(51) Int. Cl.
*B05B 11/02* (2006.01)
*B05B 12/00* (2018.01)
(Continued)

(52) U.S. Cl.
CPC ..... *B05B 11/0035* (2013.01); *A45D 34/00* (2013.01); *B05B 11/0038* (2018.08);
(Continued)

(58) Field of Classification Search
CPC ..... B05B 11/0035; B05B 11/0038; B05B 11/00416; B05B 11/0054; B05B 11/02;
(Continued)

(56) References Cited

U.S. PATENT DOCUMENTS 7,665,923 B2 * 2/2010 Py ..... B65D 83/0094 401/188 R
2006/0021919 A1 2/2006 Olson et al.
(Continued)

FOREIGN PATENT DOCUMENTS

FR 2924695 A1 6/2009
WO 2016/058124 A1 4/2016

OTHER PUBLICATIONS

International Search Report for PCT/FR2018/051845 dated Oct. 9, 2018 [PCT/ISA/210].
(Continued)

*Primary Examiner* — Patrick M. Buechner
(74) *Attorney, Agent, or Firm* — Sughrue Mion, PLLC

(57) ABSTRACT

A fluid dispenser assembly having a fluid reservoir (4), a dispenser member (5), and a dispenser orifice (62). The fluid reservoir (4) includes a piston (42) movable in leaktight sliding contact in a slide cylinder (41) over a maximum stroke defined between a start position that corresponds to a substantially full state of the reservoir, and an end position that corresponds to a substantially empty state of the reservoir. The dispenser assembly further includes an RFID tag (40) that is secured to the piston (42).

14 Claims, 4 Drawing Sheets

(51) Int. Cl.
*A45D 34/00* (2006.01)
*B05B 11/00* (2006.01)

(52) U.S. Cl.
CPC ..... *B05B 11/0054* (2013.01); *B05B 11/02* (2013.01); *B05B 12/004* (2013.01); *A45D 2200/055* (2013.01)

(58) Field of Classification Search
CPC ... B05B 11/3028; B05B 12/004; A45D 34/00; A45D 2034/005; A45D 2200/055
See application file for complete search history.

(56) References Cited

U.S. PATENT DOCUMENTS

| | | | | |
|---|---|---|---|---|
| 2014/0123746 | A1* | 5/2014 | Jaffrey | G01S 13/878 73/152.18 |
| 2015/0192117 | A1* | 7/2015 | Bridges | F04B 17/05 417/53 |
| 2015/0242660 | A1 | 8/2015 | Baarman et al. | |
| 2017/0055672 | A1* | 3/2017 | Duquet | A45D 34/00 |

OTHER PUBLICATIONS

International Preliminary Report on Patentability dated Jan. 28, 2020, in International Application No. PCT/FR2018/051845.

* cited by examiner

ASSEMBLY FOR DISPENSING A FLUID PRODUCT

CROSS REFERENCE TO RELATED APPLICATIONS

This application is a National Stage of Application No. PCT/FR2018/051845 filed Jul. 19, 2018, claiming priority based on French Patent Application No. 1757067 filed Jul. 25, 2017.

The present invention relates to a fluid dispenser assembly comprising a fluid reservoir, a dispenser member, and a dispenser orifice, the reservoir including a piston that is movable in leaktight sliding contact in a slide cylinder over a maximum stroke defined between a start position that corresponds to a substantially full state of the reservoir, and an end position that corresponds to a substantially empty state of the reservoir. Thus, the assembly makes it possible to apply a fluid to a target such as the skin. Naturally, an advantageous field of application for the present invention is the field of cosmetics, but it may also be the field of pharmacy.

In the prior art, document FR 2 832 134 is known, which describes a dispenser provided with a radio frequency identification (RFID) tag that is mounted on a pump body. The RFID tag is suitable for delivering information relating to the pump: that is why it is mounted on the pump.

An object of the present invention is to use the same RFID technology in a fluid dispenser for the purpose of providing information relating to the fluid itself. Another object of the invention is to position the RFID tag in a location that is difficult to access without destroying the dispenser or emptying its reservoir.

To do this, the present invention proposes that the RFID tag is secured to the piston. Specifically, the piston is arranged in the slide cylinder and, as a result, it is only accessible when the reservoir is empty. However, when it is empty, there is no longer any reason to remove the RFID tag for the purpose of falsifying the dispenser or deleting its origin. Positioning the RFID tag on the piston is thus very astute. It is even more astute since the piston provides one of the very few plane surfaces in a dispenser that is of shape that is dominated by vertical axial symmetry. Specifically, the piston generally comprises a substantially plane plate that is surrounded by one or two piston-ring lips. The RFID tag can thus be secured to the plane plate. It may be adhesively-bonded on the face that is not in contact with the fluid, or indeed, it may be embedded in the plate of the piston (by overmolding).

In addition, the user sometimes wishes to be informed about the filling and emptying state of the dispenser reservoir. In some circumstances, it is possible to make the reservoir out of transparent material, so that the user sees what remains in the reservoir.

Document WO 2015/170048 is also known, which describes a dispenser assembly using a reservoir provided with a follower piston. Documents US 2012/267390, JP 2007/153415, and US 2012/267391 are also known, which describe systems that make it possible to give a visual indication of the position of a follower piston in a slide cylinder. However, those systems are all passive, such that the user must consult the visual indication, but does not receive information.

Another object of the present invention is to improve the fluid dispenser assemblies of the prior art by giving the user clear, reliable, and perceptible information about the filling and emptying state of the piston reservoir, by using the RFID tag that is secured to the piston.

To do this, the fluid dispenser assembly further comprises at least one transmit antenna that is suitable for sending a signal to the RFID tag and for receiving a return signal transmitted by the RFID tag. The return signal gives an indication about the distance between the RFID tag and the antenna. Advantageously, the dispenser assembly further comprises: power measurement means that are suitable for measuring the power level of the return signal transmitted by the RFID tag; and warning means that inform the user that a determined power level has been measured, corresponding to a determined filling state of the reservoir. In a practical embodiment, the warning means are formed by a portable computer, advantageously a smartphone. In this configuration, they are external: the smartphone thus communicating remotely with the dispenser assembly using any protocol, such as Bluetooth, Wifi, RFID, Zigbee, Lora, Sigfox, etc. It is also possible to envisage warning means that are internal to the dispenser assembly, such as (optionally audible) vibration, an audible signal (a beep), LEDs, or a screen.

By way of example, the warning position is reached when the piston has moved through more than 75%, or more than 90%, or even 100%, of its maximum stroke from its start position. However, it is also possible to envisage other additional warning positions, e.g. at half the maximum stroke of the piston, or at one-fourth of its stroke. By way of example, the piston may reach a plurality of successive warning positions as it moves towards the end position, the warning positions being successively deduced from the sensed power levels, triggering a plurality of distinct respective warning signals.

In a preferred embodiment, two transmit antennas are positioned spaced apart from each other, power measurement means measuring the respective power levels of the return signals transmitted by the RFID tag and received by each of the two transmit antennas, and comparison means being provided so as to compare the measured power levels, in order to deduce therefrom the filling state of the reservoir. The information about power levels sensed by the two antennas is cross-checked, correlated, or cross-referenced so as to determine accurately the location of the piston supporting the RFID tag.

According to an advantageous characteristic of the invention, said at least one antenna, the power measurement means, and the comparison means are mounted on a printed circuit. Preferably, the fluid reservoir, the dispenser member, and the dispenser orifice are formed by a dispenser that is removably insertable into a casing forming an applicator surface and incorporating the printed circuit that extends substantially parallel to a plane that contains the fluid reservoir, the dispenser member, and the dispenser orifice.

Advantageously, said at least one antenna is positioned in contact with the slide cylinder, or in its immediate proximity, so as to reduce the distance between it and the piston. The power levels that are picked up are thus higher and less sensitive to any potential external disturbances.

In most configurations, the piston is a follower piston that moves when the fluid in the fluid reservoir is under suction. In other configurations, the piston is a pusher piston, making it possible to put the fluid in the reservoir under pressure.

The spirit of the invention resides in storing information relating to the fluid in the dispenser in secure and tamper-proof manner by positioning the RFID tag on the piston. In addition, the use of power levels transmitted by the RFID tag in order to deduce therefrom the filling and emptying state of the reservoir imparts an additional function to the RFID tag.

The invention is described below in greater detail with reference to the accompanying drawings, which show an embodiment of the invention by way of non-limiting example.

Figure 3:
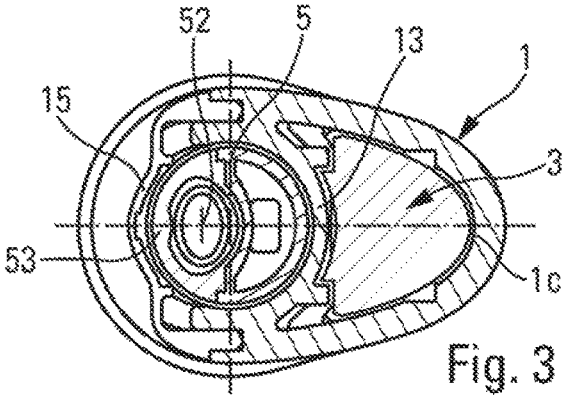
FIG. 3 is a horizontal cross-section view on section line A-A in FIG. 2.

Firstly, the present invention is illustrated with reference to FIGS. 1 to 8, which show a dispenser and applicator assembly similar to the dispenser and applicator assembly in document WO 2015/170048, with the addition of remote detection. The dispenser and applicator assembly presents an elongate or slender shape that may be similar to the shape of a pen. It should also be observed that its cross-section is not constant, since it varies significantly from bottom to top. Specifically, in the proximity of its bottom end, the dispenser and applicator assembly presents a cross-section that is generally round or circular, while at the section line A-A, which is generally situated in the proximity of the top end, the dispenser and applicator assembly presents a cross-section that is egg shaped (FIG. 3). The top face of the assembly forms an applicator surface S that inclines or slopes towards one side.

Figure 4:
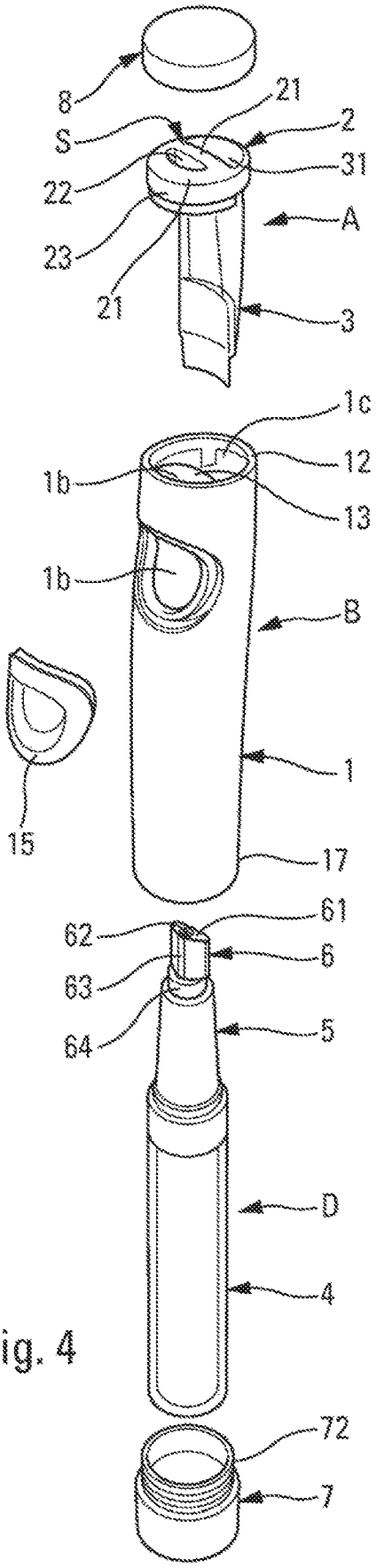
FIG. 4 is an exploded perspective view of the dispenser and applicator assembly in the above figures.
Figure 5:
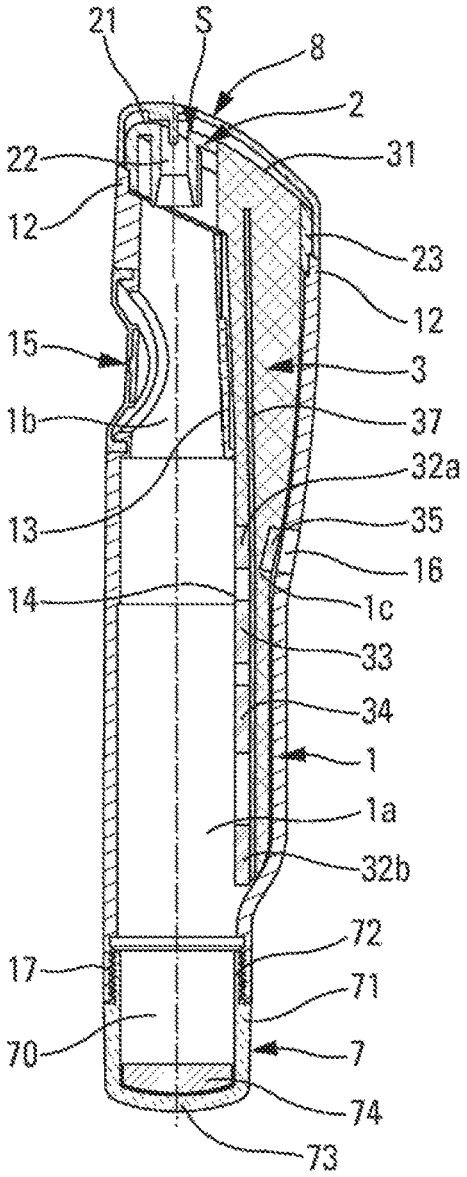
FIG. 5 is a view similar to the view in FIG. 1, in the absence of a fluid dispenser.

With reference to FIG. 4, it is possible to see the various component elements of the dispenser and applicator assembly of the invention. Initially, it should be observed that it comprises three main distinct units, namely a dispenser unit D, a reception unit B, and an applicator unit A. The dispenser unit D, which is a fluid dispenser, is advantageously received in removable manner inside the reception unit B that comprises a single-piece reception body 1 having an inside that is hollow. The applicator unit A is mounted on and in the body 1, advantageously in removable manner. Thus, the two units D and A are preferably received in removable manner on and in the body 1 from the two opposite ends 17 and 12 respectively. This is the general structure of the dispenser and applicator assembly of the invention.

In greater detail, the body 1 of the reception unit B is open at its top and bottom ends 12, 17 so as to be able to receive the units A and D. The inside of the bottom end 17 is advantageously threaded so as to receive a removable end wall 7 by screw-fastening. The removable end wall presents the shape of a small pot with a bottom wall 73 and a cylindrical side wall 71 having a top portion that forms a thread 72 having a pitch that corresponds to the pitch of the bottom end 17 of the body 1. It should be observed that on top of its bottom wall 73, the removable end wall 7 is provided with a piece of elastic material 74 that may be foam or an elastomer. The inside of the removable end wall 7 forms a space 70 that communicates upwardly with the inside of the body 1, which itself defines a reception space 1*a*. Beyond the reception space 1*a*, the inside of the body 1 is divided into two compartments 1*b* and 1*c* by a separating partition 13. The compartment 1*b* extends axially running on from the space 1*a*, while the compartment 1*c* extends laterally, where the body 1 defines its egg shape. The bottom end of the partition 13 forms a snap-fastener edge 14, as described below. Level with the compartment 1*b*, the body 1 is provided with a lateral pusher 15 that is movable transversally relative to the longitudinal axis of the reception body 1. The pusher 15 may be moved purely in translation or it may be deformed elastically. By way of example, it is possible to envisage molding the pusher 15 onto the reception body 1, using an elastomeric material. In a variant, it is also possible to envisage a pusher 15 that moves completely independently of the body 1. It is also possible to envisage not having a pusher 15 but only an opening. It should also be observed that the separator partition 13 extends into the proximity of the top end 12. The reception body 1 may be made merely by injection molding plastics material, or it may even be made of metal.

Figure 1:
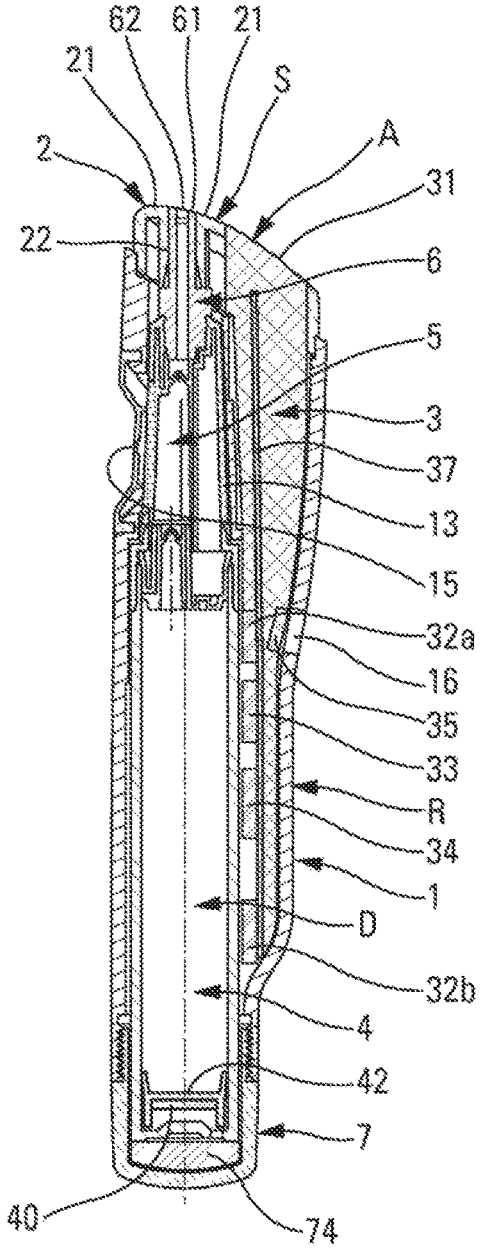
FIG. 1 is a substantially life-size vertical-section view through a fluid dispenser and applicator assembly of the invention.
Figure 2:
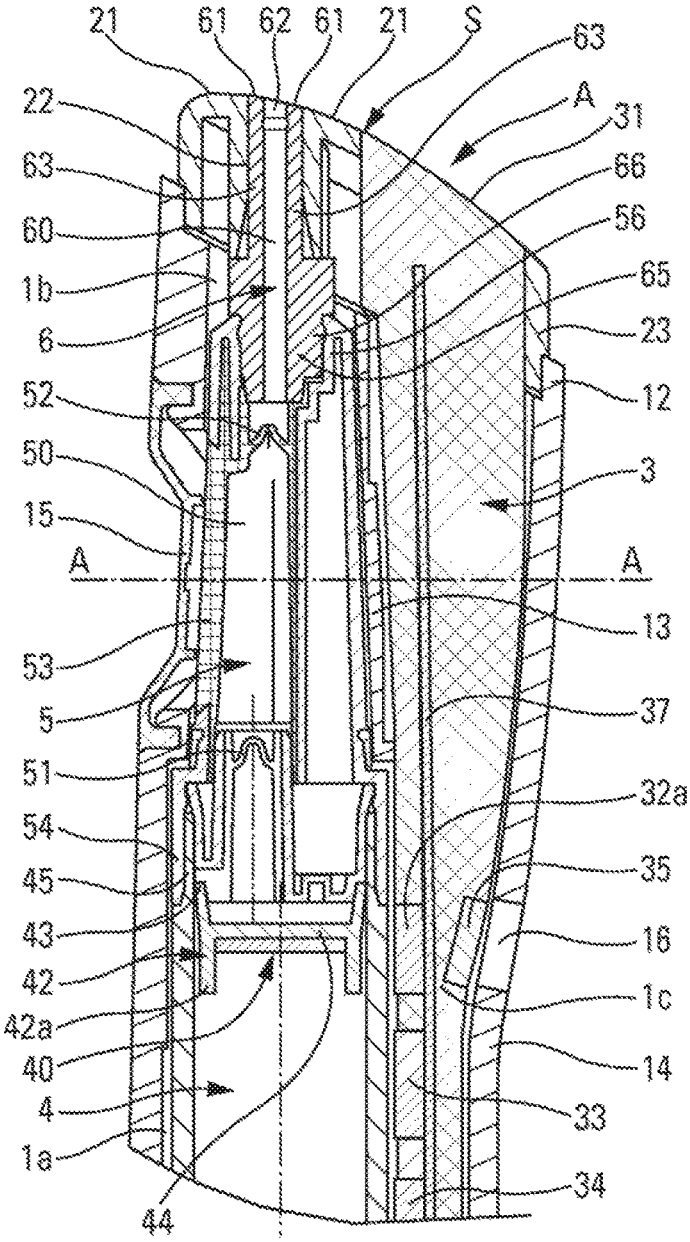
FIG. 2 is a greatly enlarged view of the top portion of FIG. 1.

In this embodiment, the applicator unit A results from combining an applicator head 2 and a wave-generator module 3. As can be seen in FIGS. 1 and 2, the applicator head 2 includes an axial housing 22 that is formed by a cylindrical tube having a cross-section that presents a geometrical shape that is complex, e.g. the shape of a crescent. The housing 22 is upwardly connected to an applicator-surface area 21 that, in this embodiment, is formed with two openings, namely a first opening corresponding to the mouth of the housing 22, and a second opening for the module 3. More precisely, the module 3 includes an applicator-surface section 31 that closes the corresponding opening of the head 2 in such a manner as to complete the applicator-surface area 21 of the head 2 in continuous and smooth manner. In other words, the module 3 fits in the opening of the applicator head, so that the applicator-surface section 31 of the module 3 finishes off the applicator-surface area of the head 2 without creating any projecting or recessed discontinuities. Consequently, assembling the module 3 and the head 2 together makes it possible to create an applicator surface S having a single opening that, at this stage, is formed by the mouth of the housing 22. In FIGS. 1 and 2, it should be observed that the applicator-surface section 31 occupies the portion of the applicator surface S that slopes the most. The applicator head 2 also includes a peripheral skirt 23 that fits in the top end 12 of the hollow body 1. In addition, the wave-generator module 3 extends inside the reception space 1*c*.

The wave-generator module 3 makes it possible to generate any type of electromagnetic, vibratory, etc. wave or radiation, e.g. visible, infrared, or ultraviolet light, or microwaves, etc., or even ultrasound, or mechanical vibration. The module 3 may also generate heat or cold (thermal waves) so as to impart a hot or cold effect on contact with the skin. It may also use iontophoresis. The module includes all of the components necessary for it to function, some of which are mounted on a printed circuit 37.

Figure 7:
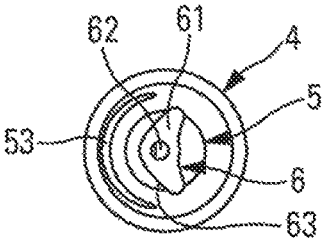
FIG. 7 is a plan view of the FIG. 6 dispenser.
Figure 6:
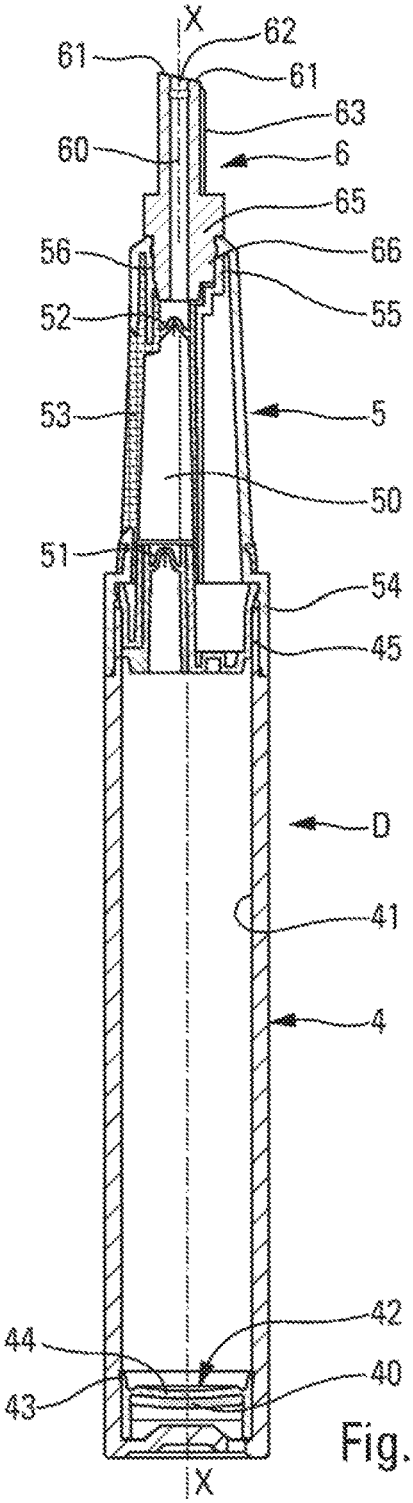
FIG. 6 is a vertical section view through a fluid dispenser of the invention.
Figure 8:
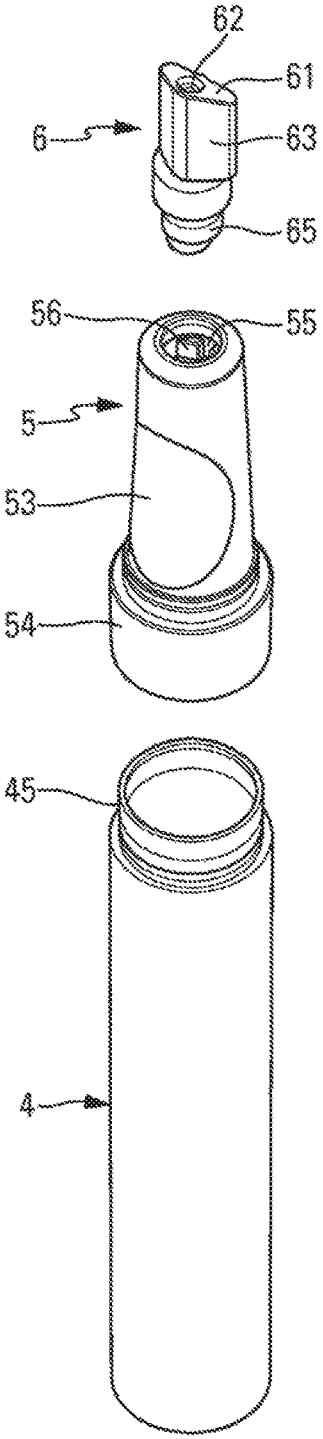
FIG. 8 is an exploded perspective view of the dispenser in FIGS. 6 and 7.

The dispenser unit or fluid dispenser D comprises a fluid reservoir 4, a pump 5, and a dispenser endpiece 6, as can be seen more clearly in FIGS. 6 to 8.

By way of example, the reservoir 4 may be in the form of a slide cylinder 41 in which there is received a follower piston 42 that is adapted to slide in the cylinder 41 as the fluid is extracted from the reservoir. The top of the cylinder 41 forms a neck 45. The follower piston 42 comprises a bushing 42*a* that is substantially cylindrical, having a top end that forms a piston-ring lip 43 that is in leaktight sliding contact in the slide cylinder 41. In the bushing 42*a* there extends an annular plate 44 that is substantially flat or plane and that is provided on its bottom face that is not in contact with the fluid, with an RFID tag 40 that is described in greater detail below.

The pump 5 includes a fastener ring 54 that enables it to be mounted on the neck 45 of the reservoir 4. The pump 5 includes a pump chamber 50 that, at its bottom end, is provided with an inlet valve 51, e.g. in the form of a slotted shutter. At its top end, the pump chamber 50 includes an outlet valve 52 that may also be made in the form of a slotted shutter, for example. Furthermore, the pump chamber 50 includes a lateral actuator 53 that makes it possible to reduce the working volume of the pump chamber 50, and thus force the fluid through the outlet valve 52. The lateral actuator 53 is movable perpendicularly to the longitudinal axis X of the dispenser D. The movement may be in translation or by elastic deformation. In the embodiment used to illustrate the present invention, the actuator 53 is in the form of a flexible wall of the pump chamber 50 that is made by a method of bi-injection or of overmolding, for example. The pump 5 may thus be referred to as a flexible-diaphragm pump, in the sense that a movable wall of the chamber is actuated directly in order to put the fluid under pressure. At its top end, the pump 5 forms a mounting well 56 for mounting the dispenser endpiece 6. The mounting well 56 is advantageously provided with keying means 55, e.g. in the form of a projecting profile or a recess, making it possible to impose the angular orientation of the endpiece 6 in the well 56.

The dispenser endpiece 6 thus includes a mounting stub 65 that is engaged, and advantageously snap-fastened, inside the mounting well 56. The mounting stub 65 includes a keying profile that fits perfectly in the keying means 55 of the well 56, so as to impose the angular orientation of the dispenser endpiece 6 on the pump 5. In this way, the endpiece is always oriented in the same way relative to the lateral actuator 53 that extends on one side only of the pump 5. Above the mounting stub 65, the dispenser endpiece 6 forms an insertion appendage 63 having a cross-section that presents a shape that corresponds to the shape of the housing 22 formed by the applicator head 2. This shape can be seen more clearly in FIG. 7: it is similar to the shape of a crescent. The side wall of the insertion appendage 63 may be a non-circular cylinder over its entire height. In a variant, one or more projecting sealing beads may be provided, making it possible to establish sealing inside the housing 22. At its top end, the appendage 63 forms a substantially-plane outlet surface 61 that is perforated with a dispenser orifice 62, forming the outlet of an outlet duct 60 that passes through the appendage 63 and the mounting stub 65, as can be seen clearly in FIGS. 2 and 6.

Once the dispenser endpiece 6 is mounted on the pump 5, as can be seen in FIG. 6, it can be seen that the outlet valve 51 communicates directly with the outlet duct 60. Thus, by depressing the lateral actuator 53, the working volume of the pump chamber 50 is reduced, and fluid under pressure is forced through the outlet valve 52, from where it can flow through the outlet duct 60 until it reaches the dispenser orifice 62 situated at the outlet surface 61. When the pressure on the lateral actuator 53 is relaxed, the outlet valve 52 closes and the inlet valve 51 opens under the effect of the suction created in the pump chamber 50, thus enabling fluid to be sucked up from the reservoir 4, in which the follower piston 42 then moves towards the pump 5.

As can be understood from FIG. 4, the dispenser unit of the dispenser D is inserted inside the hollow body 1 through its bottom end 17, after removing the removable end wall 7. The dispenser D is thus inserted axially through the space 1*a*, then through the space 1*b* until the dispenser endpiece 6 penetrates into the housing 22 of the applicator head 2. As explained above, it is necessary to orientate the dispenser D angularly, so that its insertion appendage 63 is engaged inside the housing 22. The angular orientation is preferably a single angular orientation. It is thus possible to engage the appendage 63 fully inside the housing 22 until the outlet surface 61 comes level with the applicator surface S so as to finish it off. This can be seen in FIG. 2. It can be seen that the outlet surface 61 becomes completely flush with the applicator-surface area 21 of the head 2 so as to finish it off. Finally, only the dispenser orifice 62 breaks the continuity of the applicator surface S. In order to guarantee that the appendage 63 is engaged fully in the housing 22, use is made of the removable end wall 7 having flexible material 64 that comes into contact with the end wall of the reservoir 4 so as to push it upwards, and establish sealing at the housing 22. In this respect, it should also be observed that the bottom end of the reservoir 4 projects out from the hollow body 1 when the removable end wall 7 is removed, so as to make it easy to grip the dispenser by its reservoir 4 in order to remove it from the hollow body 1. As a result, the dispenser D is received in removable manner inside the hollow body 1 and the head 2. It should also be observed that the imposed angular orientation of the appendage 63 inside the housing 22 makes it possible to arrange the lateral actuator 53 facing the pusher 15 of the hollow body 1.

FIG. 3 shows the arrangement of the various component elements of the dispenser and applicator assembly of the invention, where it presents its egg shape. By way of example, it is possible to see that the generator module 3 is received inside the compartment 1*c* that is defined by the separator partition 13 that surrounds, in part, the pump 5, having its lateral actuator 53 covered by the lateral pusher 15. It can thus be said that the pump 5 is arranged between the module 3 and the pusher 15, inside the hollow body 1.

With such a design, the applicator unit A is received in removable manner on and in the reception unit R. In addition, the dispenser unit of the dispenser D is also received in removable manner inside the reception unit R and inside the housing 22 of the applicator unit A. In this way, the dispenser D and the applicator unit A may be replaced at will as a function of requirements. By way of example, it is possible to envisage that a particular dispenser dispensing a particular fluid is associated with a particular applicator unit. It thus suffices to mount the two units A and D in the reception unit R in order to constitute the dispenser and applicator assembly of the invention. When it is necessary to replace the units A and D, it is possible to remove each of them easily from the reception unit R. It should also be observed that the fluid dispensed by the dispenser D leaves the dispenser only at the applicator surface S, such that no fluid can remain inside the reception unit R once the dispenser has been removed. Furthermore, as a result of the applicator surface S being completely smooth and continuous, it can easily be cleaned by rubbing or wiping. Thus, when a user wishes to change a dispenser, it suffices for the user to clean the applicator surface S beforehand, then to remove the dispenser and replace it with another. No soiling or fluid deposit can be observed.

In the embodiment used to illustrate the present invention, the wave-generator module 3 forms an applicator-surface sector 31. This is a particular non-limiting embodiment only, since it is entirely possible to envisage making the wave-generator module 3 without it forming a portion of the applicator surface S. By way of example, the module 3 may be associated with the applicator head 2 just below the applicator surface S, which applicator surface thus serves as diffuser means for diffusing the waves.

The complete independence between the dispenser D and the applicator unit A, except when assembled in the housing 22, makes it possible to disassociate the two units completely, such that they may be produced by entirely different suppliers, namely a supplier specialized in the design of dispensers, and a supplier specialized in the design of electronic wave-generator modules.

As mentioned above, in this particular assembly, the piston 42 is provided with an RFID tag 40 that comprises a chip and an antenna in conventional manner. Any type of passive RFID tag can be used in the context of the invention, although Near Field Communication (NFC) and Ultra High Frequency (UHF) technologies are preferred. The tag 40 can easily be adhesively-bonded under the annular plate 44 or incorporated in the plate by overmolding. The location of the RFID tag 40 is particularly astute because it is inaccessible, since the follower piston is arranged inside the reservoir 4, the bottom of which is integrally closed. Thus, the RFID tag 40 can be accessed only by destroying the reservoir 4 or by emptying the reservoir in order to extract the follower piston 42 therefrom.

The RFID tag 40 can contain information relating to the fluid stored in the reservoir or indeed relating to the dispenser D. The information is delivered by the RFID tag 40, following a request sent by an antenna. In greater detail, the antenna sends a request signal to the RFID tag 40, which returns an information signal with a given power level that depends on the power of the request signal, on the distance between the antenna and the RFID tag 40, and on the nature of the elements interposed between the antenna and the RFID tag.

In the invention, the dispenser assembly is further provided with means for giving a visual and/or audible indication or information to the user of the assembly about the filling and emptying state of the reservoir 4. The information may be given on the dispenser assembly or it may be communicated remotely to a smartphone or a computer having a dedicated application or software installed thereon.

In the invention, the antenna that serves to collect the information from the RFID tag 40 is incorporated in the dispenser assembly, more precisely in the dispenser D, and more precisely still in the printed circuit 37. The antenna could also be made by a flex circuit or by a coiled antenna. In the non-limiting embodiment that serves to illustrate the invention, the printed circuit 37 extends over almost all of the height of the body 1, running along the dispenser D, and more particularly its slide cylinder 41. The printed circuit 37 supports a plurality of components, including two transmit antennas 32*a* and 32*b* that are spaced apart from each other axially. The antenna 32*a* is situated level with the follower piston 42 when the reservoir 4 is empty (FIG. 2), and the antenna 32*b* is situated level with the bottom end of the hollow body 1, i.e. at one-third of the stroke of the follower piston 42. In the figures, it should be observed that the two antennas 32*a* and 32*b* are almost in contact with the slide cylinder 41 that separates them from the follower piston 42 supporting the RFID tag 40. The printed circuit 37 also supports power measurement means 33 that are suitable for measuring the power level of the return signal transmitted by the RFID tag 40. Given that the two antennas 32*a* and 32*b* are spaced apart from each other, each of them senses a different power level, which power levels vary in opposite directions. Specifically, when the follower piston 42 is at the beginning of its stroke at the bottom of the reservoir 4, the power level picked up by the antenna 32*b* is at, or almost at, its maximum, whereas the power level picked up by the antenna 32*a* is at its minimum. The power levels picked up are equal when the follower piston 42 is positioned exactly mid-way between the two antennas 32*a* and 32*b*.

In order to compare the measured power levels, comparison means 34 are provided that make it possible to deduce, from the measured power levels, the filling state of the reservoir. Finally, warning means 35, which are visual (LED) or audible through a slot 16, inform the user that a determined power level has been measured, corresponding to a determined filling state of the reservoir 4. The warning means may also be formed by a portable computer, advantageously a smartphone.

To summarize, the RFID tag 40 serves to determine the position of the follower piston 42, and in particular its final position shown in FIG. 2, corresponding to an empty state of the reservoir 4. A warning signal is thus issued. However, it is also possible to envisage other additional warning positions, e.g. at half the maximum stroke of the piston, or at one-fourth of its stroke. By way of example, the piston may reach a plurality of successive warning positions as it moves towards the end position, the warning positions being successively deduced from the sensed power levels, triggering a plurality of distinct respective warning signals.

Figure 9:
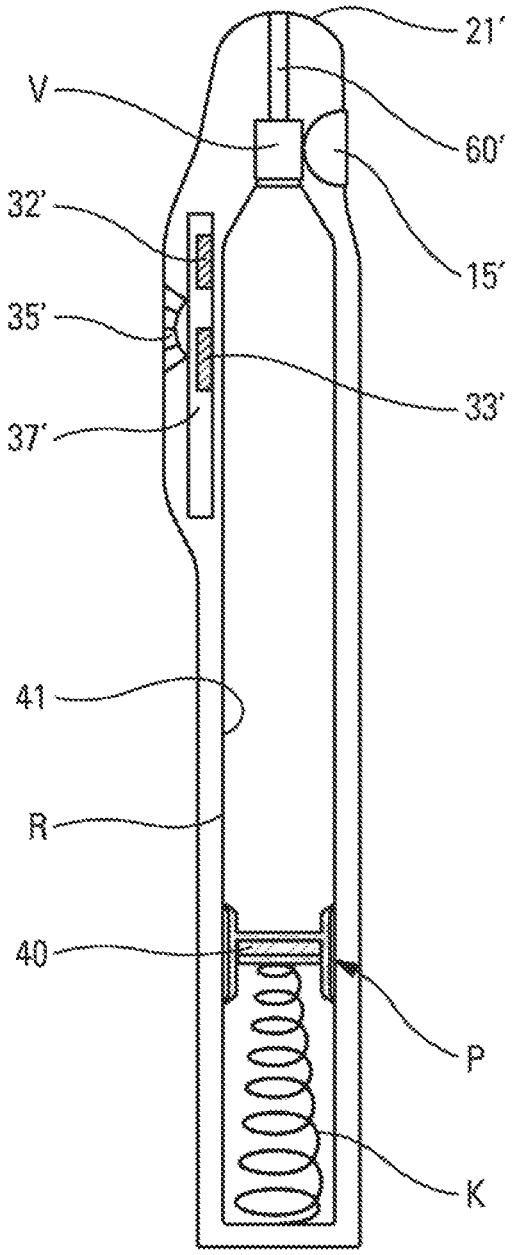
FIG. 9 is a diagrammatic section view through a fluid dispenser and applicator assembly constituting a second embodiment of the invention.

Reference is made below to FIG. 9 in order to describe a second embodiment of the invention. The FIG. 9 dispenser and applicator assembly is shown in very diagrammatic manner only, but it is possible to identify a fluid reservoir R forming a slide cylinder 41 inside which there is mounted a piston P that is driven by a spring K. Thus, the fluid stored inside the reservoir R is subjected to pressure exerted by the piston P that is driven by the spring K. At its opposite end, the reservoir R is connected to a dispenser valve V that is actuatable by means of a pusher 15'. Thus, the user may press on the pusher 15' so as to open the dispenser valve V, so that the fluid stored under pressure in the reservoir R is forced through the open valve and then through an outlet duct 60', so as to reach an applicator surface 21'. In this dispenser assembly, the reservoir R may also be in the form of a cartridge that is insertable into the dispenser assembly in such a manner as to become connected to the dispenser valve V. In a variant, the dispenser valve V may form an integral part of the cartridge.

In the invention, the dispenser assembly is also fitted with a printed circuit 37' on which there is mounted a transmit antenna 32' that is situated at the end of stroke of the piston P that supports an RFID tag 40 that is embedded in the material constituting the piston P, e.g. by overmolding. Thus, when the piston P moves from its initial position, shown in FIG. 9, to its final position, level with the antenna 32', the power level of the signal transmitted by the RFID tag 40 increases. The printed circuit 37' also supports power measurement means 33' that are suitable for measuring the power level of the return signal transmitted by the RFID tag 40. When the piston P reaches a determined position corresponding to the determined power level, a warning signal is sent to an audible warning system 35', possibly mounted on the printed circuit 37'.

Compared to the first dispenser assembly in FIGS. 1 to 8, the second dispenser assembly differs in that the piston P is not a follower piston but a pusher piston that is driven by a force, e.g. by a spring, and there is only one antenna 32'. The antenna 32' is arranged at the end of stroke of the piston, but it could also be positioned at some other location.

The invention thus provides an identifiable dispenser assembly including a reservoir in which a piston (a follower piston or a pusher piston) moves, and having a filling and emptying state that can advantageously be communicated to the user.

The invention claimed is:

1. A fluid dispenser assembly comprising a fluid reservoir (4; R), a dispenser member (5; V), and a dispenser orifice (62), the fluid reservoir (4; R) including a piston (42; P) that is movable in leaktight sliding contact in a slide cylinder (41) over a maximum stroke defined between a start position and an end position, the dispenser assembly further comprises an RFID tag (40) that is secured to the piston (42; P) and warning means (35) that informs the user that a determined power level of the return signal transmitted by the RFID tag has been measured, corresponding to a determined filling state of the reservoir (4; R).

2. A dispenser assembly according to claim 1, wherein the warning means are formed by a portable computer.

3. A dispenser assembly according to claim 1, wherein the piston (42) is a follower piston that moves when the fluid in the fluid reservoir (4) is under suction.

4. A dispenser assembly according to claim 1, wherein the piston (42; P) comprises a plate (44) that is surrounded by at least one piston-ring lip (43), the RFID tag (40) being secured to the plate (44).

5. The dispenser assembly according to claim 1, wherein the warning means are formed by a smartphone.

6. A dispenser assembly according to claim 1, further comprising at least one transmit antenna (32*a*, 32*b*; 32') that is suitable for sending a signal to the RFID tag (40) and for receiving a return signal transmitted by the RFID tag (40).

7. A dispenser assembly according to claim 6, wherein said at least one antenna (32*a*, 32*b*; 32') is positioned in contact with the slide cylinder (41), or in its an immediate proximity of the slide cylinder, so as to reduce the distance between it and the piston (42; P).

8. A fluid dispenser assembly comprising a fluid reservoir (4; R), a dispenser member (5; V), and a dispenser orifice (62), the fluid reservoir (4; R) including a piston (42; P) that is movable in leaktight sliding contact in a slide cylinder (41) over a maximum stroke defined between a start position and an end position;

the dispenser assembly further comprises:

an RFID tag (40) that is secured to the piston (42; P), two transmit antennas (32*a*, 32*b*; 32') configured to send a signal to the RFID tag (40) and to receive a return signal transmitted by the RFID tag (40), and the two transmit antennas (32*a*, 32*b*) are positioned spaced apart from each other, each receiving measured power levels of return signals transmitted by the RFID tag (40), and a comparator circuit is provided and configured to compare the measured power levels, in order to deduce therefrom a filling state of the reservoir (4).

9. The dispenser assembly according to claim 8, wherein the piston (42) is a follower piston that moves when the fluid in the fluid reservoir (4) is under suction.

10. The dispenser assembly according to claim 8, wherein the piston (42; P) comprises a plate (44) that is surrounded by at least one piston-ring lip (43), the RFID tag (40) being secured to the plate (44).

11. A fluid dispenser assembly comprising a fluid reservoir (4; R), a dispenser member (5; V), and a dispenser orifice (62), the fluid reservoir (4; R) including a piston (42; P) that is movable in leaktight sliding contact in a slide cylinder (41) over a maximum stroke defined between a start position and an end position, the dispenser assembly further comprises an RFID tag (40) that is secured to the piston (42; P) and at least one transmit antenna (32*a*, 32*b*; 32') configured to send a signal to the RFID tag (40) and to receive a return signal transmitted by the RFID tag (40); and wherein said at least one antenna a power measurement circuit and a comparator circuit configured to compare measured power levels are mounted on a printed circuit (37).

12. A dispenser assembly according to claim 11, wherein the fluid reservoir (4; R), the dispenser member (5; V), and the dispenser orifice (62) are formed by a dispenser (D) that is removably insertable into a casing (B) forming an applicator surface (S) and incorporating the printed circuit (37; 37') that extends substantially parallel to a plane that contains the fluid reservoir (R), the dispenser member (5; V), and the dispenser orifice (62).

13. The dispenser assembly according to claim 11, wherein the piston (42) is a follower piston that moves when the fluid in the fluid reservoir (4) is under suction.

14. The dispenser assembly according to claim 11, wherein the piston (42; P) comprises a plate (44) that is surrounded by at least one piston-ring lip (43), the RFID tag (40) being secured to the plate (44).

* * * * *